United States Patent [19]

Weller

[11] 4,098,461

[45] Jul. 4, 1978

[54] PIPE NIPPLE FOR THE DISCHARGE OF A SOLID WATER JET

[75] Inventor: Kurt Weller, Menden, Fed. Rep. of Germany

[73] Assignee: Franz Scheffer oHG, Menden, Fed. Rep. of Germany

[21] Appl. No.: 748,574

[22] Filed: Dec. 8, 1976

[30] Foreign Application Priority Data

Jul. 9, 1976 [DE] Fed. Rep. of Germany ..... 2630860

[51] Int. Cl.[2] ..... B05B 1/08

[52] U.S. Cl. ..... 239/101; 239/381; 239/383

[58] Field of Search ..... 239/101, 102, 382, 384, 239/488, 552

[56] References Cited

U.S. PATENT DOCUMENTS

| | | | |
|---|---|---|---|
| 2,624,559 | 1/1953 | Hyde | 239/383 X |
| 2,878,066 | 3/1959 | Erwin | 239/383 |
| 3,568,716 | 3/1971 | Heitzman | 239/383 X |
| 3,640,472 | 2/1972 | Hruby, Jr. | 239/552 |

FOREIGN PATENT DOCUMENTS

| | | | |
|---|---|---|---|
| 2,342,612 | 3/1975 | Fed. Rep. of Germany | 239/102 |

*Primary Examiner*—John J. Love
*Attorney, Agent, or Firm*—John C. Smith, Jr.

[57] ABSTRACT

A pipe nipple for the discharge of a solid water jet, particularly from the center of the shower head of a shower bath, is provided with an external screw thread on its water entry end and with two insets of which one is fitted tightly into each of the pipe nipple ends. Each inset has a number of openings for the passage therethrough of the water and a central bore for the reception of one of the axle pins of a spinner rotatably mounted between the two insets. The spinner has one or more obliquely pitched blades of a radial cross section at least equal to the cross section of the water openings in the entry end inset.

6 Claims, 10 Drawing Figures

PIPE NIPPLE FOR THE DISCHARGE OF A SOLID WATER JET

BACKGROUND OF THE INVENTION

This invention relates to a pipe nipple for the discharge of a solid water jet, particularly from the center of the shower head of a shower bath.

A pipe nipple of such a kind screwed centrally into the shower head of a shower bath has already been described. This shower head can be set to discharge either a circular shower of water from so-called grooved rings or a solid jet of water from the central pipe nipple through which the water is in this case conducted exclusively. In this known type of shower head the water discharge from the pipe nipple is a continuous unbroken jet.

SUMMARY OF THE INVENTION

It is an object of the present invention to provide a pipe nipple which enables the solid jet to be discharged in the form of a pulsating stream suitable for effecting a pulse massage of the skin of the user.

Another object is the provision of a pipe nipple of the contemplated kind with a minimum of means.

Yet another object of the invention is the provision of such a pipe nipple which is completely reliable in operation.

According to the present invention these objects are achieved substantially by a pipe nipple provided with an external screw thread at its water entry end and with two insets of which one is fitted tightly into each of its ends, each inset containing a number of openings for the passage therethrough of the water and with a central bore for the reception of one of the axle pins of a spinner rotatably mounted between the two insets, and having one or more blades of a radial cross section at least equal to the cross section of the water openings in the entry end inset.

In a preferred embodiment the openings in the insets are open axial grooves of circularly arcuate cross section formed in the peripheral surface of the insets. It is also advantageous when the radius of curvature of the circularly arcuate cross section of the axial grooves in the inset at the exit end of the pipe nipple is greater than that of the circularly arcuate cross section of the axial grooves in the inset at the entry end of the pipe nipple. Through a nipple according to the invention the solid jet of water is not discharged in a continuous unbroken stream but rather in the form of a rapid sequence of pulses. This is due to the spinner because this is rotated by the water impinging at uniform speed on its obliquely pitched blades which in rapid alternation obstruct and uncover the axial passages formed in the periphery of the entry inset.

Conveniently the nipple, the two insets and the spinner, i.e. only four separate parts, can be readily and economically produced at low cost in the form of synthetic plastics moldings. These parts can be assembled easily and quickly without special tools. The two axle pins of the spinner provide satisfactory radial and axial location between the two insets. Moreover, owing to the uniform speed of the rotating spinner the issuing jet of water is pulsed at a uniform rate. The insets may be secured in the nipple by a firm press fit. They are preferably so aligned that the radial bisectors of the cross sections of the water passages through both insets are in axial register. Moreover, the production of the proposed pipe nipple can be even further simplified by producing the body of the nipple and one inset, for instance that at the exit end, in the form of an integral molding. In such a case the only remaining assembly operations consist in inserting the spinner and then pressing the entry inset into place. The speed of rotation of the spinner, which should be made of a material that will not swell, depends upon the pitch of the blades.

The employment of a pipe nipple according to the invention is by no means limited to the heads of a shower bath. Such a pipe nipple can also be fitted to the end of a hose by a suitable threaded ring. By providing water openings in the insets in the form of axial grooves molded into their peripheral surface the stability and strength of these parts is assured notwithstanding the presence of the center bore for the reception of the axle pins of the spinner.

Moreover, as already stated, it is preferred that the radius of curvature of the axial peripheral grooves is greater in the inset at the exit end of the nipple, because the resultant increase in the cross section of flow ensures that the water will be discharged in the form of an unobstructed solid pulsed jet. The speed of the spinner depends upon the entry velocity of the water. This can be raised by reducing the cross sections of the water passages through the inset at the entry end of the nipple, in relation to the cross section of the passages at the exit end.

BRIEF DESCRIPTION OF THE DRAWINGS

An embodiment of the invention will now be described by way of example and with reference to the accompanying drawings, in which.

DESCRIPTION OF THE PREFERRED EMBODIMENT

Figure 1:
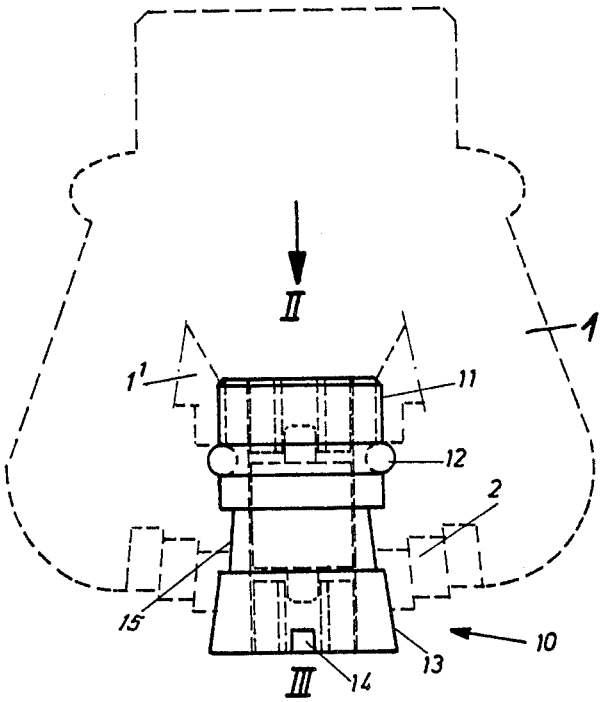
FIG. 1 is a side elevational view of a pipe nipple according to the invention.

FIG. 1 shows a pipe nipple 10 which may be made of synthetic plastics. Part of the pipe nipple 10 at its water entry end is provided with external screw threads 11 extending as far as a peripheral groove for the reception of a sealing ring 12. The exit end 13 of the pipe nipple 10 externally widens in the form of a truncated cone.

The external screw threads 11 are adapted to engage corresponding internal screw threads $1^1$ in the shower head 1 (indicated in chain line contours).

The water issues from the pipe nipple 10 in the form of a solid jet when the shower head 1 has been appropriately adjusted. In an alternative adjustment a shower of water issues concentrically about the pipe nipple 10 instead of a jet. For the generation of this shower a number of interposed grooved rings 2 which are preferably in the form of an integral unit (shown in FIG. 1 in chain line contours) are provided. As will be understood from FIG. 1 these rings surround each other and are relatively staggered, the smallest diameter ring bearing directly on the coned exit end 13 of the pipe nipple 10.

The end face at the coned exit end 13 of the pipe nipple 10 is provided with transverse slots 14 which permit the pipe nipple to be screwed into position and unscrewed with an ordinary screwdriver.

At the entry end of the pipe nipple a plastics inset 20 is fitted into the interior of the nipple and fixed in position by a bonding adhesive or by the interengagement of interfitting parts.

Figure 2:
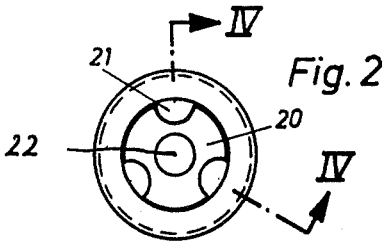
FIG. 2 is an end view of the pipe nipple seen from the water entry side, as indicated by an arrow II in FIG. 1.
Figure 5:
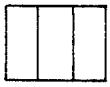
FIG. 5 is a side view of the inset on the entry side.
Figure 5A:
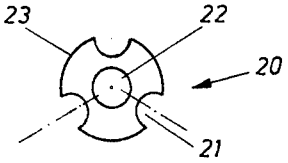
FIG. 5A is an end thereof.

This inset 20 contains, as shown in FIGS. 2 and 5A, a central bore 22 as well as three equiangularly disposed axial grooves 21 of semicircular cross section forming axial passages for the water in the peripheral surface 23 of the inset 20.

Figure 3:
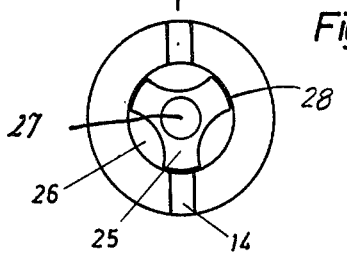
FIG. 3 is an end view of the pipe nipple from the water exit side, as indicated by an arrow III in FIG. 1.

FIG. 3 shows another inset 25, likewise made of plastics material, which is fitted into the exit end of the pipe nipple 10 and is likewise secured by means of an adhesive, a fusion bond or by the interengagement of interfitting parts. This inset 25 also has a central bore 27 as well as three axial passages 26 of semicircular cross section formed into its peripheral surface 28. However, the curvature of the sides of these axial passages in inset 25 in the exit end of the pipe nipple is not as pronounced as in the inset 20 in the entry end of the pipe nipple. Consequently the cross section of these passages is greater than that of the passages in inset 20 at the entry end. The two insets 20 and 25 are fitted into the pipe nipple in such a way that the radial bisectors of the cross section of their respective passages are in axial register.

Figure 4:
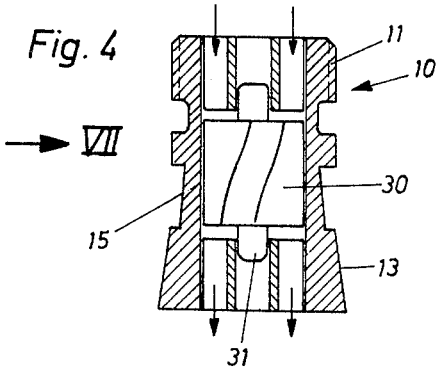
FIG. 4 is a section taken on the line IV — IV of FIG. 2.
Figure 7:
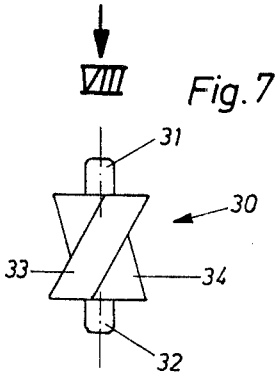
FIG. 7 is a side view of the spinner seen in the direction VII in FIG. 4.
Figure 6:
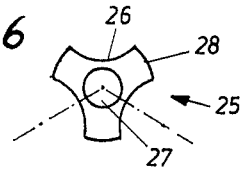
FIG. 6 is an end view of the inset on the exit side.
Figure 8:
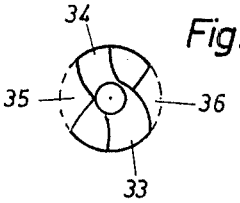
FIG. 8 is an end view of the spinner in the direction VIII in FIG. 7.
Figure 6A:
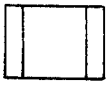
FIG. 6A is a side view thereof.

Located between the two insets inside the pipe nipple is a spinner 30, likewise made of plastics material, and shaped as illustrated in FIGS. 7 and 8. The spinner 30 is formed with two blades 33 and 34, each having a surface pitched at an angle to the axial direction of flow through the pipe nipple. The spinner 30 is rotatably mounted, two short integrally formed axle pins 31 and 32 being rotatably received into the central bores 22 and 27 in the two insets 20 and 25 as shown in FIGS. 1 and 4.

As an alternative to the slots 14 the pipe nipple end might be polygonal, for instance hexagonal. A peripheral recess 15 between the conical exit end 13 and the sealing ring 12 merely serves to save material.

Viewed in the axial direction the two pitched blades 33 and 34 define two diametrically opposite sectors between which two open sectors 35 and 36 remain. The water entering the pipe nipple through the three passages 21 impinges on the pitched surfaces of the two blades 33 and 34 of the spinner 30, causing it to spin. In the course of this rotation each entry passage is uncovered and closed in alternation by each spinner blade. The water which can pass through the larger cross sections of the passages 26 in the form of solid jets will therefore be pulsed at a frequency corresponding to the speed of the spinner rotation.

The invention may be embodied in other specific forms without departing from the spirit or essential charakteristics thereof. The embodiment is therefore to be considered in all respects as illustrative and not restrictive.

What is claimed is:

1. A pipe nipple for the discharge of a solid water jet, particularly from the center of a shower head having an internal screw thread, said pipe nipple comprising:

(a) a water entry end and a water exit end;

(b) an external screw thread on said entry end adapted for threaded engagement with said internal screw thread;

(c) tool engaging means on said exit end for engagement by a tool to screw and unscrew said pipe nipple into and out of said shower head;

(d) a first inset in said entry end defining a central bore and a plurality of open axial grooves in the peripheral surface of said first inset;

(e) a second inset in said exit end spaced from and axially aligned with respect to said first inset and defining a central bore and a plurality of open axial grooves in the peripheral surface of said second inset;

(f) said axial grooves in said second inset being larger than said axial grooves in said first inset, and corresponding of said axial grooves of said insets being in axial alignment parallel to the axis of said pipe nipple;

(g) a spinner having a pair of pins axially projecting from opposite ends thereof, said pins engaging respective of said central bores of said insets, said spinner having at least two blades extending obliquely with respect to the rotational axis of said spinner with open sectors between said blades, each blade having a cross section at least equal to the cross section of said axial grooves in said first inset;

(h) whereby water flowing through said axial grooves in said first inset impinges tangentially on the pitched surfaces of said blades causing said spinner to rotate, alternately opening and closing said grooves in said first inset and resulting in solid jets of water being pulsed through said grooves in said second inset at a frequency corresponding to the rotational speed of said spinner.

2. A pipe nipple according to claim 1 wherein an equal number of equally spaced axial grooves are disposed in the peripheral surfaces of both said insets.

3. A pipe nipple according to claim 2 wherein said axial grooves in said first and second insets are of circular arcuate cross section, the circular arcuate cross section of said axial grooves in said second inset being greater than that of the circular arcuate cross section of said axial grooves in said first inset, and the axes of corresponding pairs of said axial grooves of circular arcuate cross section of both said insets being parallel to and in radial alignment with the axis of said spinner.

4. A pipe nipple according to claim 3 wherein said blades on said spinner are equally spaced about said spinner.

5. A pipe nipple according to claim 4 wherein the number of axial grooves in each of said insets is one greater than the number of said blades on said spinner.

6. A pipe nipple according to claim 5 wherein three of said axial grooves are disposed in the peripheral surface of each of said insets and two of said blades are disposed on said spinner.

* * * * *